US006074030A

United States Patent [19]

Prunty et al.

[11] Patent Number: 6,074,030

[45] Date of Patent: Jun. 13, 2000

[54] QUIET COMPARTMENT DOOR

[75] Inventors: Jeffrey L. Prunty, Cedar Rapids; Joseph M. Nurre, Coralville, both of Iowa

[73] Assignee: Amana Company, L.P., Amana, Iowa

[21] Appl. No.: 08/752,186

[22] Filed: Nov. 18, 1996

[51] Int. Cl.[7] ..... A47B 96/04

[52] U.S. Cl. ..... 312/404; 16/374

[58] Field of Search ..... 312/405.1, 404; 49/388, 397; 16/374, 376, 385, DIG. 13

[56] References Cited

U.S. PATENT DOCUMENTS

| | | | |
|---|---|---|---|
| 2,312,638 | 3/1943 | Gedris | 16/374 |
| 2,498,557 | 2/1950 | Lantz | 16/374 |
| 5,289,616 | 3/1994 | Taniyama | 16/374 |
| 5,445,452 | 8/1995 | Kaufman et al. | 312/405.1 |

FOREIGN PATENT DOCUMENTS

| | | | |
|---|---|---|---|
| 60800 | 6/1924 | Norway | 16/376 |

*Primary Examiner*—Peter M. Cuomo
*Assistant Examiner*—Gerald A. Anderson
*Attorney, Agent, or Firm*—Tobor, Goldstein & Healey, L.L.P.

[57] ABSTRACT

A refrigerator has a refrigerator cabinet and a refrigerator door. The refrigerator door is arranged to open and close with respect to the refrigerator cabinet. A storage compartment is associated with either the refrigerator cabinet or the refrigerator door, and a container door cooperates with the compartment to form a container. First and second hinge members are on the container door, and third and fourth hinge members are on the compartment. The first and third hinge members form a first hinge and the second and fourth hinge members form a second hinge between the container door and the compartment. Ribs are on the container door adjacent to, and on either side of, the first and second hinge members. The ribs contact the compartment adjacent to the third and fourth hinge members in order to permit the container door to move quietly into opened and closed positions with respect to the compartment.

12 Claims, 4 Drawing Sheets

QUIET COMPARTMENT DOOR

TECHNICAL FIELD OF THE INVENTION

The present invention is directed to a quiet door construction for an enclosure such as a dairy compartment of a refrigerator.

BACKGROUND OF THE INVENTION

Cabinets, such as those used in refrigerators, often contain storage compartments enclosed with doors that rotate about pivot points. The materials used for the compartment and the door are generally rigid materials such as rigid thermoplastics. When a rigid door is opened and closed with respect to a rigid compartment, an annoying banging sound results as the door contacts the compartment at both its fully opened and fully closed positions.

In order to deaden these banging sounds which are made when a door is opened and/or closed against its corresponding compartment, supplementary sound deadeners, such as rubber pads, flexible extrusions, gaskets, and/or the like, are placed at the contact points between the door and its corresponding compartment in order to deaden the impact sound which would otherwise be created when the door strikes the compartment.

There are several problems associated with the use of supplementary sound deadeners. For example, the use of these supplementary parts increases material and labor costs in the construction of enclosures in which these parts are used. Because of these cost concerns, supplementary sound deadeners are often applied to cushion the door only when it is closed. Thus, objectionable sounds when the door is opened are tolerated as a trade-off to the additional cost that would be required to deaden the sound arising when the door is both closed and opened. Also, supplementary sound deadeners detract from the aesthetics of the cabinet in which they are used, and they complicate cleaning because they create additional seams that trap dirt and debris. Furthermore, supplementary sound deadeners can be removed, or they may fall off, thus ending their usefulness.

The present invention is directed to a door construction which solves one or more of the above noted problems.

SUMMARY OF THE INVENTION

According to a first aspect of the present invention, a door for a compartment comprises a body, a hinge on the body, and a contacting means on the body. The hinge is arranged to facilitate movement of the body between opened and closed positions. The opened position of the body permits access to the compartment, and the closed position of the body denies access to the compartment. The contacting means contacts areas of the compartment near the hinge when the body is moved to its opened and closed positions.

According to another aspect of the present invention, a container for an appliance comprises a compartment, a door, a first hinge member on the door, a second hinge member on the compartment, and first and second contacting means on the door near the first hinge member. The compartment is arranged so as to receive items to be stored therein. The door is arranged such that the door and the compartment form the container. The first and second hinge members are arranged to facilitate movement of the door between opened and closed positions with respect to the compartment. The opened position of the door permits access to the compartment, and the closed position of the door denies access to the compartment. The first contacting means contacts a first area of the compartment near the second hinge member such that the door moves quietly to its opened position. The second contacting means contacts a second area of the compartment near the second hinge member such that the door moves quietly to its closed position.

According to yet another aspect of the present invention, a refrigerator comprises a refrigerator cabinet, a refrigerator door, a container compartment, a container door, first and second members on the container door, third and fourth members on the container compartment, a first contact area on the container door near the first member, a second contact area on the container door near the second member, a third contact area on the container door near the first member, and a fourth contact area on the container door near the second member. The refrigerator door is arranged to be opened and closed with respect to the refrigerator cabinet. The container compartment is associated with either the refrigerator cabinet or the refrigerator door, and the container compartment is arranged to receive items to be stored therein. The container door is arranged such that the container door and the container compartment cooperate to form a container. The first and third members cooperate to form a first hinge between the container door and the container compartment, and the second and fourth members cooperate to form a second hinge between the container door and the container compartment. The first contact area is arranged to contact a first area of the container compartment near the third member, and the second contact area is arranged to contact a second area of the container compartment near the fourth member, such that the container door moves quietly to a first limit position with respect to the container compartment. The third contact area is arranged to contact a third area of the container compartment near the third member, and the fourth contact area is arranged to contact a fourth area of the container compartment near the fourth member, such that the container door moves quietly to a second limit position with respect to the container compartment.

According to still another aspect of the present invention, a container comprises a compartment, a door, first and second hinge members on the door, third and fourth hinge members on the compartment, and ribs. The door cooperates with the compartment to form a container. The first and third hinge members form a first hinge between the door and the compartment, and the second and fourth hinge members form a second hinge between the door and the compartment. The ribs are adjacent to the first and second hinges. The ribs are arranged to form contact areas between the door and the compartment adjacent to the first, second, third, and fourth hinge members in order to permit the door to move quietly into opened and closed positions with respect to the compartment.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
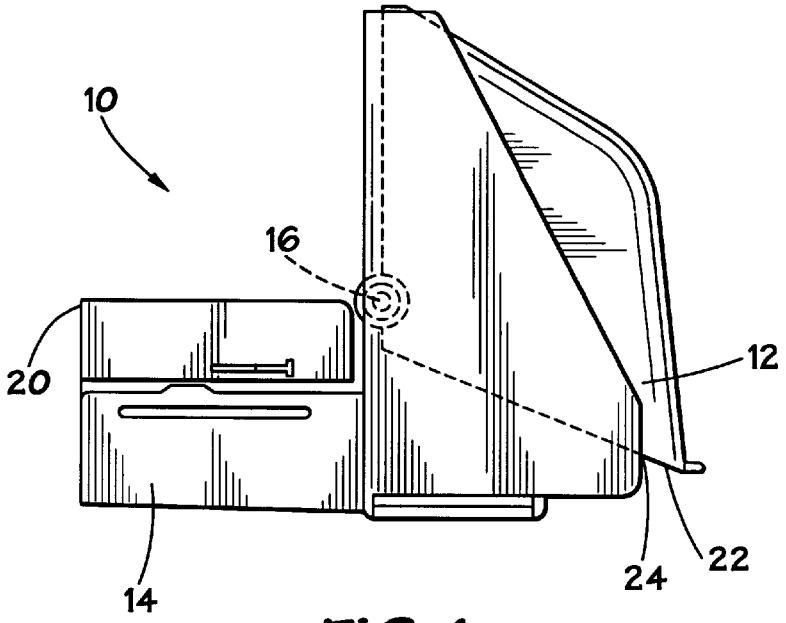
FIG. 1 (PRIOR ART)
FIG. 1 is a cross-sectional side view of a prior art door and compartment, and shows the door in a closed position with respect to the compartment.
Figure 2:
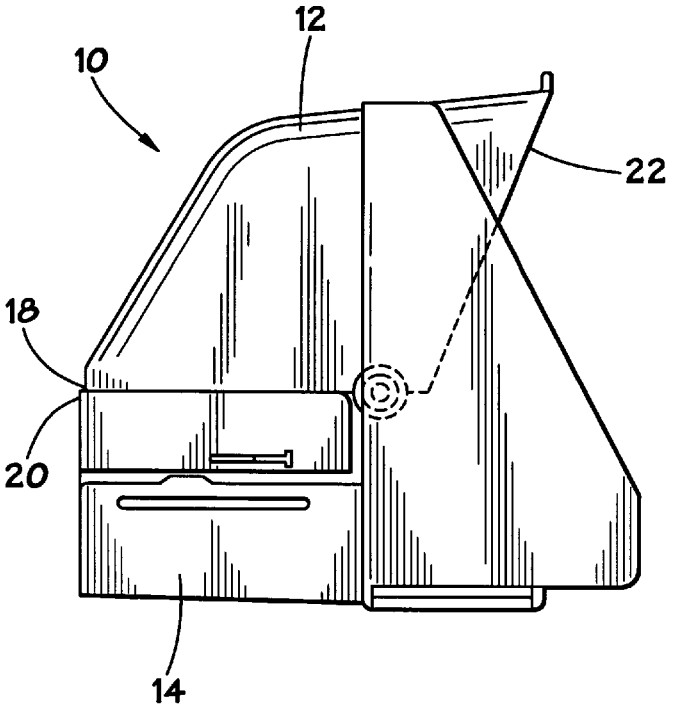
FIG. 2 (PRIOR ART)
FIG. 2 is a cross-sectional side view of the prior art door and compartment of FIG. 1, and shows the door in an opened position with respect to the compartment.

FIGS. 1 and 2 illustrate a container 10 according to the prior art. The container 10 has a door 12 and a compartment 14. The door 12 may be rotated about a pivot point 16 at each end of the compartment 14 and the door 12. Accordingly, these pivot points 16 permit the door 12 to rotated between the closed position shown in FIG. 1 and the opened position shown in FIG. 2 with respect to the compartment 14.

When the door 12 is rotated about the pivot points 16 to its opened position shown in FIG. 2, a leading edge 18 of the door 12 strikes a contact area 20 on the compartment 14 often resulting in an objectionable banging sound. Similarly, when the door 12 is rotated about the pivot points 16 to its closed position shown in FIG. 1, a leading edge 22 of the door 12 strikes a contact area 24 on the compartment 14 often resulting in an objectionable banging sound. The volume of these banging sounds depends upon the amount of energy that is transferred from the door 12 to the compartment 14 at the moment of impact. This energy is unnecessarily high because the points of impact between the door 12 and the compartment 14 are far removed from the pivot points 16.

Figure 3:
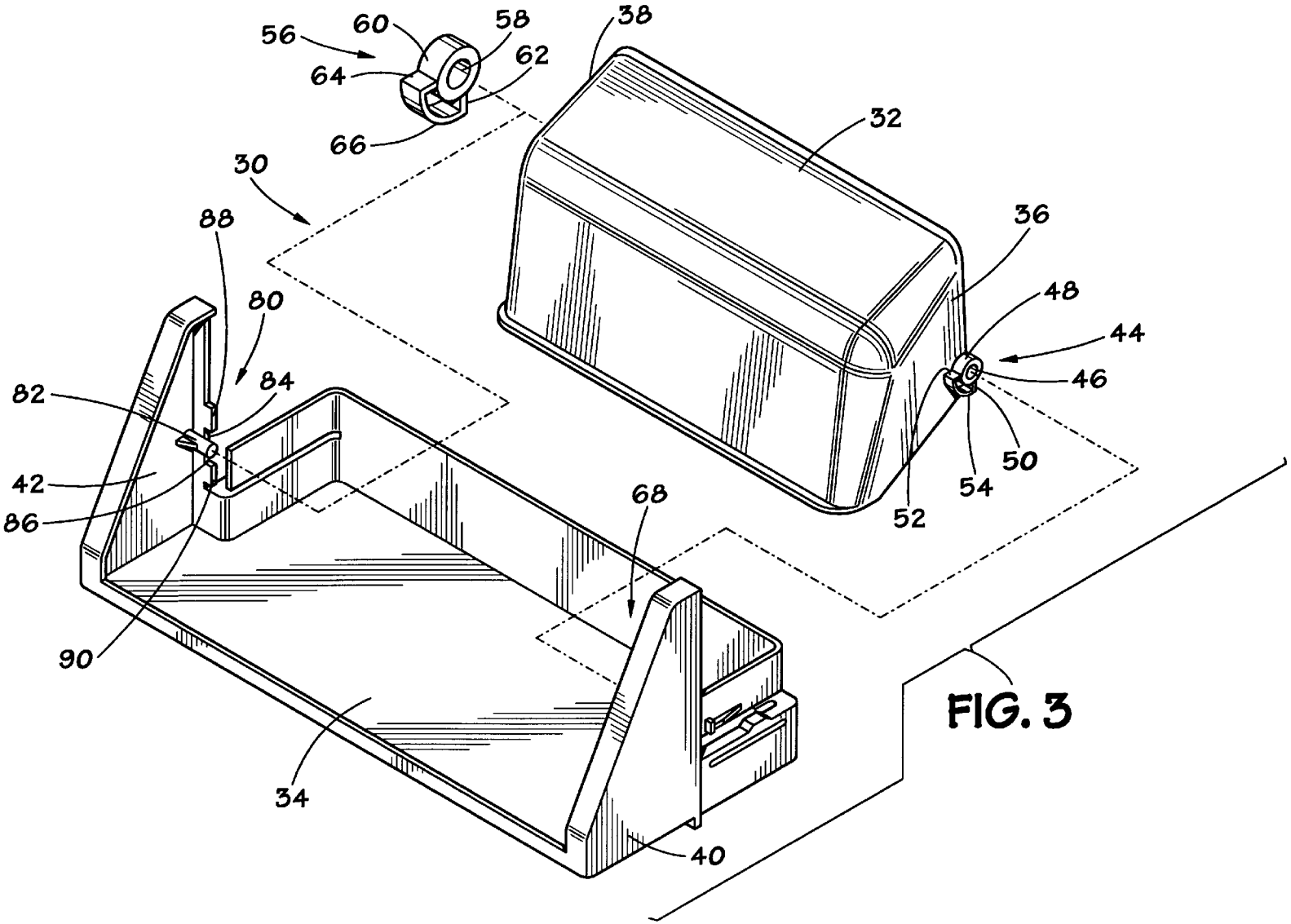
FIG. 3 is an isometric view of a door and compartment according to the present invention.
Figure 4:
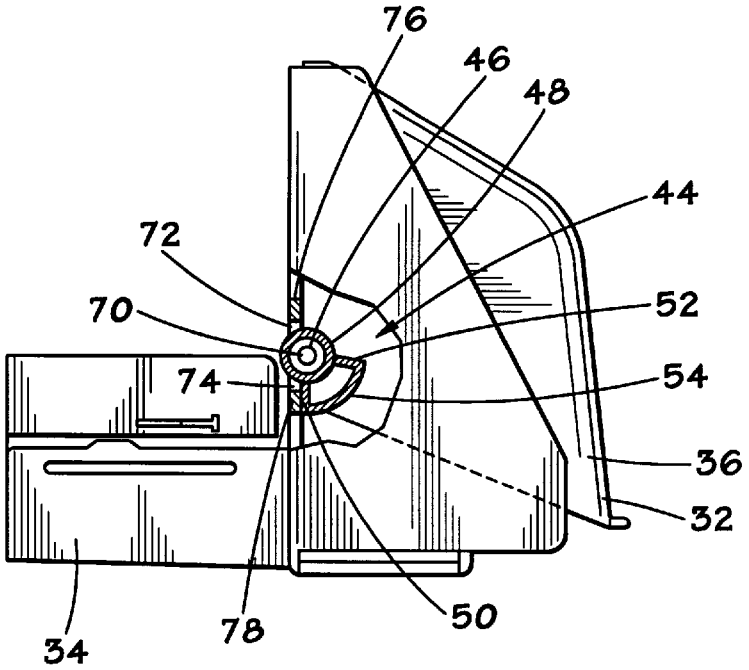
FIG. 4 is a cross-sectional side view of the door and compartment of FIG. 3, and shows the door in a closed position with respect to the compartment.
Figure 5:
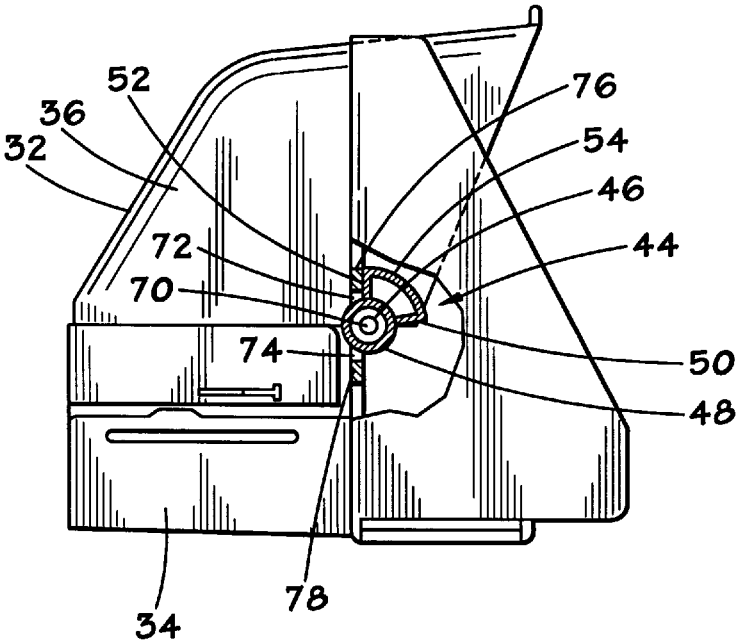
FIG. 5 is a cross-sectional side view of the door and compartment of FIG. 3, and shows the door in an opened position with respect to the compartment.

FIGS. 3, 4, and 5 show a container 30 according to a first embodiment of the present invention. The container 30 includes a door 32 and a compartment 34. The door 32 has side walls 36 and 38 at opposite ends thereof. Although the side wall 38 is not shown in the drawing, the side wall 38 may be a mirror image of the side wall 36. Similarly, the compartment 34 has side walls 40 and 42 at opposite ends thereof.

The side wall 36 of the door 32 has a first hinge member 44 thereon. The first hinge member 44, on the side wall 36 of the door 32, includes a recess 46, an annular wall 48, ribs 50 and 52, and a flange 54. The recess 46 is formed by the annular wall 48. The ribs 50 and 52 extend out from the annular wall 48 of the first hinge member 44, and are separated by a predetermined number of degrees with respect to a center of the recess 46. This predetermined number of degrees is dependent upon the particular geometry that is chosen for the door 32 and the compartment 34. The flange 54 extends between corresponding ends of the ribs 50 and 52, and is concentric with the annular wall 48. The flange 54 adds structural strength to the ribs 50 and 52.

The side wall 38 of the door 32 has a second hinge member 56 thereon. In FIG. 3, the second hinge member 56 is shown separated from the door 32 for clarity; however, it should be understood that, as in the case of the first hinge member 44, the second hinge member 56 is on the door 32 in a position on the side wall 38 that is the mirror image of the position of the first hinge member 44 on the side wall 36. The second hinge member 56, on the side wall 38 of the door 32, includes a recess 58, an annular wall 60, ribs 62 and 64, and a flange 66. The recess 58 is formed by the annular wall 60. The ribs 62 and 64 extend out from the annular wall 60 of the second hinge member 56, and are separated by a predetermined number of degrees with respect to a center of the recess 58. This predetermined number of degrees again is dependent upon the particular geometry that is chosen for the door 32 and the compartment 34. The flange 66 extends between corresponding ends of the ribs 62 and 64, and is concentric with the annular wall 60. The flange 66 adds structural strength to the ribs 62 and 64.

The first and second hinge members 44 and 56 may be formed integrally with the door 32.

The side wall 40 of the compartment 34 has a third hinge member 68 thereon. As shown in FIGS. 4 and 5, the third hinge member 68 includes a pin 70, spaces 72 and 74, and tabs 76 and 78. The pin 70 is arranged to protrude into the recess 46 of the first hinge member 44 when the door 32 is assembled to the compartment 34. The spaces 72 and 74 are disposed with respect to the pin 70 and the tabs 76 and 78, and are arranged to accommodate the annular wall 48 of the first hinge member 44 so that rotation of the first hinge member 44 about the pin 70 of the third hinge member 68 is permitted. Accordingly, the spaces 72 and 74 permit the rotation of the annular wall 48 of the first hinge member 44 about the pin 70 of the third hinge member 68. The tabs 76 and 78 form contact areas for the ribs 50 and 52 of the first hinge member 44 as is explained below in additional detail.

The side wall 42 of the compartment 34 has a fourth hinge member 80 thereon. As shown in FIG. 3, the fourth hinge member 80 includes a pin 82, spaces 84 and 86, and tabs 88 and 90. The pin 82 is arranged to protrude into the recess 58 of the second hinge member 56 when the door 32 is assembled to the compartment 34. The spaces 84 and 86 are disposed with respect to the pin 82 and the tabs 88 and 90, and are arranged to accommodate the annular wall 60 of the second hinge member 56 so that rotation of the second hinge member 56 about the pin 82 of the fourth hinge member 80 is permitted. Accordingly, the spaces 84 and 86 permit the rotation of the annular wall 60 of the second hinge member 56 about the pin 82 of the fourth hinge member 80. The tabs 88 and 90 form contact areas for the ribs 62 and 64 of the second hinge member 56 as is explained below in additional detail.

The third and fourth hinge members 68 and 80 may be formed integrally with the compartment 34. Also, the third and fourth hinge members 68 and 80 may be mirror images of one another.

Accordingly, when the door 32 is moved to its closed position with respect to the compartment 34 as shown in FIG. 4, the rib 50 of the first hinge member 44 contacts the tab 78 of the third hinge member 68, and the rib 62 of the second hinge member 56 contacts the tab 90 of the fourth hinge member 80. On the other hand, when the door 32 is moved to its opened position with respect to the compartment 34 as shown in FIG. 5, the rib 52 of the first hinge member 44 contacts the tab 76 of the third hinge member 68, and the rib 64 of the second hinge member 56 contacts the tab 88 of the fourth hinge member 80.

Because movement of the door 32 is stopped near the pivot points formed by the first hinge member 44, the second hinge member 56, the third hinge member 68, and the fourth hinge member 80, the sound of contact between the door 32 and the compartment 34 is materially reduced as compared to the sound of contact resulting when the point of contact is far removed from the pivot points, as is the case with respect to the container 10 shown in FIGS. 1 and 2. Thus, the sound of the ribs 50, 52, 62, and 64 of the first and second hinge members 44 and 56 contacting the tabs 76, 78, 88, and 90 of the third and fourth hinge members 68 and 80 is substantially muted. Also, the clearance between the pin 70 of the third hinge member 68 and the recess 46 of the first hinge member 44, and the clearance between the pin 82 of the fourth hinge member 80 and the recess 58 of the second hinge member 56 are optimized so that objectionable sound is further reduced. For example, the clearances between the outside diameter of the pin 70 of the third hinge member 68 and the inside diameter of the recess 46 of the first hinge member 44 and between the outside diameter of the pin 82 of the fourth hinge member 80 and the inside diameter of the recess 58 of the second hinge member 56 may be 0.012"±0.010". Also, there may be a nominal distance of 0.294", for example, between the center of the pin 70 of the third hinge member 68 and the inside edges of the tabs 76 and 78 and between the center of the pin 82 of the fourth hinge member 80 and the inside edges of the tabs 88 and 90.

Figure 6:
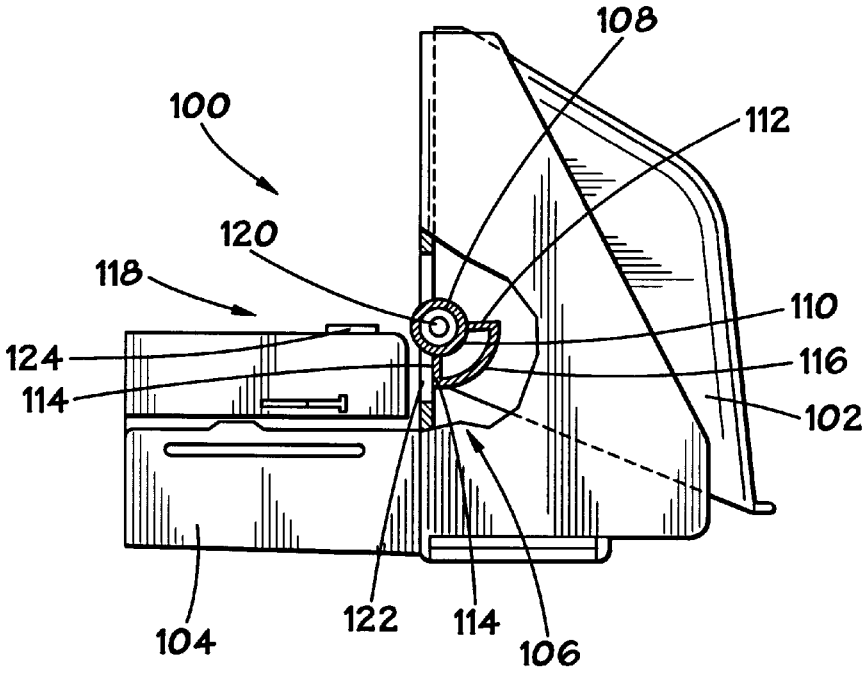
FIG. 6 is a cross-sectional side view of a door and compartment according to another embodiment of the present invention, and shows the door in a closed position with respect to the compartment; and, FIG. 7 is a cross-sectional side view of the door and compartment of FIG. 7, and shows the door in an opened position with respect to the compartment.
Figure 7:
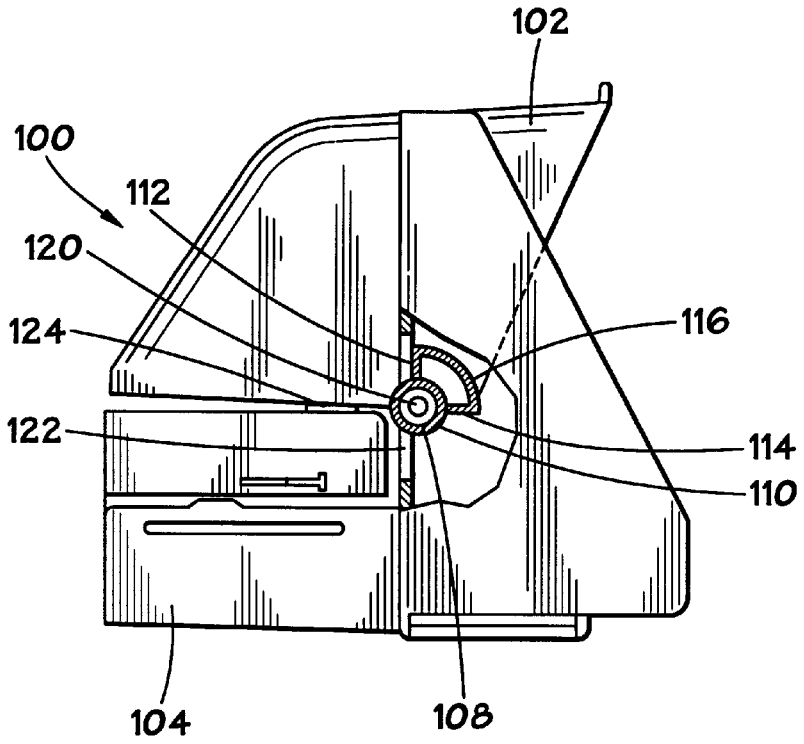

An alternative hinge arrangement is shown in FIGS. 6 and 7 which illustrate a container 100 having a door 102 and a compartment 104. The door 102 carries a first hinge member 106 on one side wall thereof. As in the case of the first hinge member 44 described above, the first hinge member 106 includes a recess 108, an annular wall 110, ribs 112 and 114, and a flange 116. The recess 108 is formed by the annular wall 110. The ribs 112 and 114 extend out from the annular wall 110 of the first hinge member 106, and are separated by a predetermined number of degrees with respect to a center of the recess 108. This predetermined number of degrees again is dependent upon the particular geometry that is chosen for the door 102 and the compartment 104. The flange 116 extends between the ends of the ribs 112 and 114 that are farthest away from the recess 108, and the flange 116 is concentric with the annular wall 110. The flange 116 adds structural strength to the ribs 112 and 114. The first hinge member 106 may be formed integrally with the door 102.

The compartment 104 has a third hinge member 118 thereon. The third hinge member 118 includes a pin 120, spaces, and tabs 122 and 124. The pin 120 and the tab 124 are on a side wall of the compartment 104, the tab 122 is on a horizontal member of the compartment 104, and the spaces of the third hinge member 118 are between the pin 120 and the tabs 122 and 124. The pin 120 is arranged to protrude into the recess 108 of the first hinge member 106 when the door 102 is assembled to the compartment 104. The spaces of the third hinge member 118 are disposed with respect to the pin 120 and the tabs 122 and 124, and are arranged to accommodate the annular wall 110 of the first hinge member 106 so that rotation of the first hinge member 106 about the pin 120 of the third hinge member 118 is permitted. Accordingly, the spaces of the third hinge member 118 permit the rotation of the annular wall 110 of the first hinge member 106 about the pin 120 of the third hinge member 118. The tabs 122 and 124 form contact areas for the ribs 112 and 114 of the first hinge member 106. The third hinge member 118 may be formed integrally with the compartment 104.

Similar second and fourth hinges may be provided at the other ends of the door 102 and the compartment 104, respectively. These second and fourth members may be formed integrally with the cover 102 and the compartment 104.

Accordingly, when the door 102 is moved to its closed position with respect to the compartment 104 as shown in FIG. 6, the rib 114 of the first hinge member 106 contacts the tab 114 of the third hinge member 118, and a similar rib of the second hinge member contacts a similar tab of the fourth hinge member. On the other hand, when the door 102 is moved to its opened position with respect to the compartment 104 as shown in FIG. 7, the rib 112 of the first hinge member 106 contacts the tab 122 of the third hinge member 118, and a similar rib of the second hinge member contacts a similar tab of the fourth hinge member.

Because movement of the door 102 is stopped near the pivot points formed by the first hinge member 106, the second hinge member, the third hinge member 118, and the fourth hinge member, instead of at points farther away from these pivot points as in the case of the container 10 of FIGS. 1 and 2, the sound of contact between the door 102 and the compartment 104 is substantially muted. Thus, there is very little sound when the ribs of the first and second hinge members contact the tabs of the third and fourth hinge members. Also, the clearance between the pin 120 of the third hinge member 118 and the recess 108 of the first hinge member 106, and the clearance between the pin of the fourth hinge member and the recess of the second hinge member are optimized so that objectionable sound is further reduced.

Therefore, by optimizing the geometry of the door and the compartment of a container according to the present invention, the door is prevented from contacting the compartment at a point remote from the pivot point between the door and the compartment. Accordingly, objectionable sounds are substantially reduced or eliminated. The door travel can be controlled in both the closed and opened positions which further enhances the quality of the product at no additional cost.

Certain modifications of the present invention have been discussed above. Other modifications will occur to those practicing in the art of the present invention. For example, as described above, the hinge between the door and the compartment is a recess in the door and a pin on the compartment. However, the hinge between the door and the compartment may instead be provided by a pin on the door and a recess in the compartment, and hinge members other than pins are recesses may be provided for the hinges between doors and compartments.

Also, the hinge members shown herein have been described as being integrally formed with their corresponding doors and compartments. However, the hinge members shown herein may be separate from, and suitably attached to, their corresponding doors and compartments.

Moreover, as described above, tabs are provided for the first and second hinge members in order to contact the contact areas of the third and fourth hinge members. Instead, contact areas other than tabs may be provided for the first and second hinge members in order to contact the contact areas of the third and fourth hinge members.

In addition, as described above, the ribs and corresponding flanges are on the door 32/102, and the tabs are on the compartment 34/104. Instead, the ribs and corresponding flanges may be on the compartment 34/104, and the tabs may be on the door 32/102.

Furthermore, particular containers have been described herein in connection with the present invention. However, the present invention may apply to other forms of enclosures, to other forms of doors such as covers and the like, and to other forms of compartments such as bins and the like.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A refrigerator comprising:

a refrigerator cabinet;

a refrigerator door, wherein the refrigerator door is arranged to be opened and closed with respect to the refrigerator cabinet;

a container compartment, wherein the container compartment is associated with one of the refrigerator cabinet and the refrigerator door, and wherein the container compartment is arranged to receive items to be stored therein;

a container door, wherein the container door is arranged such that the container door and the container compartment cooperate to form a container;

first and second members on the container door and third and fourth members on the container compartment, wherein the first and third members cooperate to form a first hinge between the container door and the container compartment, and wherein the second and fourth members cooperate to form a second hinge between the container door and the container compartment;

a first contact area on the container door adjacent the first member and a second contact area on the container door adjacent the second member, wherein the first contact area is arranged to contact a first area of the container compartment adjacent the third member, and wherein the second contact area is arranged to contact a second area of the container compartment adjacent the fourth member, such that the container door moves quietly to a first limit position with respect to the container compartment; and, a third contact area on the container door adjacent the first member and a fourth contact area on the container door adjacent the second member, wherein the third contact area is arranged to contact a third area of the container compartment adjacent the third member, and wherein the fourth contact area is arranged to contact a fourth area of the container compartment adjacent the fourth member, such that the container door moves quietly to a second limit position with respect to the container compartment, the first and third contact areas being corresponding first and third ribs formed integrally with the first member, the second and fourth contact areas being corresponding second and fourth ribs formed integrally with the second member.

2. The refrigerator of claim 1 wherein the first and third ribs are formed integrally with a flange therebetween, and wherein the second and fourth ribs are formed integrally with a flange therebetween.

3. The refrigerator of claim 1 wherein an imaginary first line through the first and second contact areas is substantially parallel to an imaginary second line through the first and second hinges, and wherein an imaginary third line through the third and fourth contact areas is substantially parallel to the imaginary first and second lines.

4. A container comprising;

a compartment, the compartment arranged to receive items to be stored therein;

a door, wherein the door cooperates with the compartment to form a container;

first and second members on the door and third and fourth members on the compartment, wherein the first and third members cooperate to form a first hinge between the door and the compartment, and wherein the second and fourth members cooperate to form a second hinge between the door and the compartment;

a first contact area on the door adjacent the first member and a second contact area on the door adjacent the second member, wherein the first contact area is arranged to contact a first area of the compartment adjacent the third member, and wherein the second contact area is arranged to contact a second area of the compartment adjacent the fourth member, such that the door moves quietly to a first limit position with respect to the compartment; and, a third contact area on the door adjacent the first member and a fourth contact area on the door adjacent the second member, wherein the third contact area is arranged to contact a third area of the compartment adjacent the third member, and wherein the fourth contact area is arranged to contact a fourth area of the compartment adjacent the fourth member, such that the door moves quietly to a second limit position with respect to the compartment, the first and third contact areas being corresponding first and third ribs formed integrally with the first member, the second and fourth contact areas being corresponding second and fourth ribs formed integrally with the second member.

5. The container of claim 4, wherein the first and third ribs are formed integrally with a flange therebetween, and wherein the second and fourth ribs are formed integrally with a flange therebetween.

6. The container of claim 4, wherein an imaginary first line through the first and second contact areas is substantially parallel to an imaginary second line through the first and second hinges, and wherein an imaginary third line through the third and fourth contact areas is substantially parallel to the imaginary first and second lines.

7. A refrigerator comprising:

a refrigerator cabinet;

a refrigerator door, wherein the refrigerator door is arranged to be opened and closed with respect to the refrigerator cabinet;

a container compartment, wherein the container compartment is associated with one of the refrigerator cabinet and the refrigerator door, and wherein the container compartment is arranged to receive items to be stored therein;

a container door, wherein the container door is arranged such that the container door and the container compartment cooperate to form a container;

a first member on the container door and a second member on the container compartment, wherein the first and second members cooperate to form a first hinge between the container door and the container compartment;

a first contact area on the container door adjacent the first member, wherein the first contact area is arranged to contact a first area of the container compartment adjacent the second member, such that the container door moves quietly to a first limit position with respect to the container compartment; and, a second contact area on the container door adjacent the first member, wherein the second contact area is arranged to contact a second area of the container compartment adjacent the second member, such that the container door moves quietly to a second limit position with respect to the container compartment, the first and second contact areas being corresponding first and second ribs formed integrally with the first member.

8. The refrigerator of claim 7, further comprising a third member on the container door and a fourth member on the container compartment, wherein the third and fourth members cooperate to form a second hinge between the container door and the container compartment.

9. The refrigerator of claim 8, further comprising a third contact area on the container door adjacent the third member and a fourth contact area on the container door adjacent the third member, wherein the third contact area is arranged to contact a third area of the container adjacent the fourth member such that the container door move quietly to the first limit position with respect to the container compartment, and the fourth contact area is arranged to contact a fourth area of the container compartment adjacent the fourth member such that the container door moves quietly to the second limit position with respect to the container compartment.

10. The refrigerator of claim 9, wherein the third and fourth contact areas are corresponding third and fourth ribs formed integrally with the third member.

11. The refrigerator of claim 10, wherein the third and fourth ribs are formed integrally with a flange therebetween.

12. The container of claim 7, wherein the first and second ribs are formed integrally with a flange therebetween.

* * * * *